United States Patent [19]

Lange

[11] Patent Number: 4,572,249

[45] Date of Patent: Feb. 25, 1986

[54] APPARATUS FOR THE MANUFACTURE OF WIRE NET FABRIC

[75] Inventor: Gerhard Lange, Reutlingen, Fed. Rep. of Germany

[73] Assignee: Wafios Maschinenfabrik GmbH & Co. KG, Fed. Rep. of Germany

[21] Appl. No.: 558,971

[22] Filed: Dec. 7, 1983

[30] Foreign Application Priority Data

Dec. 15, 1982 [DE] Fed. Rep. of Germany ..... 3246381

[51] Int. Cl.[4] ..... B21F 27/04

[52] U.S. Cl. ..... 140/92.6; 140/92.94; 72/142

[58] Field of Search ..... 140/92.3–92.94; 72/142

[56] References Cited

U.S. PATENT DOCUMENTS

| | | | |
|---|---|---|---|
| 3,144,887 | 8/1964 | Bergandi et al. | 140/92.6 |
| 4,048,826 | 9/1977 | Lechner et al. | 72/142 |
| 4,112,721 | 9/1978 | Takase et al. | 72/142 |
| 4,351,371 | 9/1982 | Mann et al. | 140/92.3 |

FOREIGN PATENT DOCUMENTS 1160396 7/1964 Fed. Rep. of Germany .

*Primary Examiner*—Lowell A. Larson

*Attorney, Agent, or Firm*—Wigman & Cohen

[57] ABSTRACT

A fabric manufacturing device having a drive to rotate a coiling mandrel (the so-called weaving blade), which, in order to avoid the difficulties of positioning the mandrel by means of motor, transmission, coupling and brake and in order to improve the productivity of the device, utiizes an electro-hydraulic torque amplifier as the mandrel drive, having an electrical step motor as a set-point value indicator, a switch valve as a servovalve and a hydromotor as an actual drive motor. A control device is provided which includes a positioning element for the step-wise positioning of the coiling mandrel in the rotational positions desired for certain points in time. In this manner, the invention automatically assures that the mandrel will precisely reach the desired rotational position and assures manufacturing of fabric with the highest possible rate of addition.

14 Claims, 3 Drawing Figures

APPARATUS FOR THE MANUFACTURE OF WIRE NET FABRIC

BACKGROUND OF THE INVENTION

The present invention relates to apparatus for the manufacture of wire net fabric made from at least one straight supplied endless wire. The apparatus has a stationary twisting worm screw, which includes a helical guide groove for each supplied wire for holding said wires, whereby two grooves are displaced axially relative to each other by the amount of the width of a single weave. The invention apparatus also has a flat coiling mandrel which cooperates with the twisting worm screw and which receives the flat-drawn wire coil formed from each wire and leads it axially to the entrance of a circular twisting tube, which has a slot along one axis-parallel cover line, through which slot the projecting bent loops of the securable last coil of the finished fabric section engage in the tube, into which loops the coiling mandrel threads the next coil as it leaves said mandrel, the beginning of which next coil can be determined by means of a cutting device, and having a drive means to rotate the coiling mandrel about its longitudinal axis, which is aligned with the tube axis.

In known devices of the above-described type, such as that disclosed in DE-PS No. 1 160 396 to Wafios, the mandrel drive consists of a motor portion, a transmission portion and a coupling portion, with which a braking portion is associated, so that the coiling mandrel, the so-called weaving blade, can be brought to a stop as rapidly as possible during uncoupling. Because this stopping is dependent upon chance and uncertainties, it does not occur with precise positioning. Therefore, at an additional operating expense, which presupposes a corresponding additional structural expense, the weaving blade must be brought into its original rotational position each time, before the cutting device separates the preceeding wire coil located in the weaving tube from the subsequent wire coil sitting on the weaving blade. Without that positioning, the cutting point would not be defined on the coil wire and it could then lead to operational disruptions as the next coil is threaded into the preceeding weaving batch.

In prior art devices of the type described hereinbefore, the rotational speed of the weaving blade can be changed step-wise by switching the transmission portion. During such a switch the electro-mechanically controlled uncoupling-braking process must be adapted to the new rotational speed, for example by displacing the switch lug of a contactless switch. Furthermore, the rotational speed is limited to the speed at which the next coil can be smoothly threaded into the preceeding coil, namely over the entire width of the fabric. Disruptions are possible not only at the beginning, where the subsequent coil is introduced into the preceeding coil, but also toward the end of the threading operation, where, due to the increasing width of the fabric, increasing difficulties are encountered as a result of the fact that the friction of the bent loops of the flattened wire coil on the inner wall of the weaving tube, which is dependent on the coil length, coil pitch and wire thickness, leads to a torsion in the rotating coil in the weaving tube. That results in a change in the coil pitch, which, in turn, causes the beginning of the coil to miss the rearmost openings in the finished section of fabric. In the case of an addition of two intertwined wire coils to the woven edge by threading one of the two coils into the last coil of the finished fabric section, it has also been noted that at too high a rotational speed of the weaving blade, the indirectly added coil is improperly threaded into the fabric edge with the directly added coil, so that, at least the uniform structure of the fabric is disturbed. However, if the rotational speed of the weaving blade is necessarily held so low that the aforementioned disruptions do not occur, the productivity of the device is only moderate.

SUMMARY AND OBJECTS OF THE INVENTION

In view of the above-discussed disadvantages of the prior art devices, it is an object of the present invention to create a similar device which avoids any special expense for the positioning of the weaving blade and also makes small structural changes unnecessary in the selection of a different rotational speed of the weaving blade. It is a further object of the present invention to provide apparatus which makes possible a significantly higher rate of production by a design that eliminates nonuniformities in the fabric production.

Those and other objects are achieved according to the invention with a device of the above-described type, in that an electro-hydraulic torque amplifier is provided as the mandrel drive means, having an electric step-motor as the set-point value indicator, a switch valve as a servovalve and a hydro-motor as the actual drive motor, and a control device for the set-point value indicator is provided which includes a positioning element for the step-wise positioning of the coiling mandrel in the rotational positions desired for given points in time.

The apparatus according to the present invention advantageously permits a certain timed operation at the rotational speed of the weaving blade during the threading of a wire coil into the fabric edge to be adjusted in such a manner, and thereby to set an intermediate constant rotational speed of the weaving blade without infinite gradations or steps in such a manner, that the fabric production takes place at the highest possible rate of growth without disruptions. It has been found to be advantageous to operate with a slower increasing or decreasing rotational speed of the weaving blade at the beginning and at the end of the threading of a wire coil than in the area therebetween, where the highest rotational speed is possible, having no disadvantageous effect on the stopping of the weaving blade prior to use of the cutting device.

During its operaton, the apparatus according to the present invention automatically insures that the weaving blade always perfectly reaches the desired rotational position, particularly the original, and simultaneously the end, rotational positions, before the wire is cut. The precision depends only on the number of rotational steps of the step motor per entire (or half, in the production of half loops or stitches) rotation of the weaving blade. An additional advantage of the apparatus according to the present invention is seen in the fact that its mandrel drive is free of wear and operates at a low noise level, because of the absence of coupling and braking fittings. Thus, no coupling impact occurs.

In a preferred embodiment of the apparatus according to the invention, the positioning portion is provided with at least one of the following manually adjustable data input members:

(a) a potentiometer to simultaneously coordinate the rate of climb and the end of an acceleration curve of the rotational speed of the coiling mandrel; and/or (b) a potentiometer to establish a constant rotational speed of the coiling mandrel; and/or (c) a preselection switch to determine the beginning of a delay curve of the rotational speed of the coiling mandrel; and/or (d) a potentiometer to determine the rate of decline of the delay curve and simultaneously to determine the end of this curve, if necessary.

Use of the inventive apparatus with any of those members can assure optimum productivity of the apparatus and of the quality of the manufactured fabric, whereby the optimal operating conditions for a given fabric can be empirically determined during a test running of the apparatus.

In the preferred embodiment, the positioning portion is also provided with a preselection switch to adjust the step rate or speed of the step motor necessary to produce a wire coil. The use of such an additional preselection switch also makes it possible to set the fabric width in a simple manner.

In the preferred embodiment the control device has, in addition to the positioning element, a programmable function element to cyclically start and control the positioning element according to the 37 master-slave" principle. Indicating and adjusting members are connected to that function element, which members, for example, control the intermittent transport of the finished fabric section and the periodic engagement of the so-called fabric hooks into openings in the edge of the fabric. The programmable function element of the control device makes it possible to set and coordinate weaving blade rotation in time dependence function and the functions of other mechanical apparatus elements associated with the fabric structure.

In the preferred embodiment, the functon element is programmed in memory, so that a complete program of different fabrics, which differ from each other in wire thickness, opening width and fabric width, insures that the fabric manufacture can proceed automatically.

In the preferred embodiment, the function element is provided with manually adjustable signal input members, in order to be able to select individual functions individually or in conjunction with each other and to bring them into or out of effect, or in order to be able to place the apparatus in a given condition.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
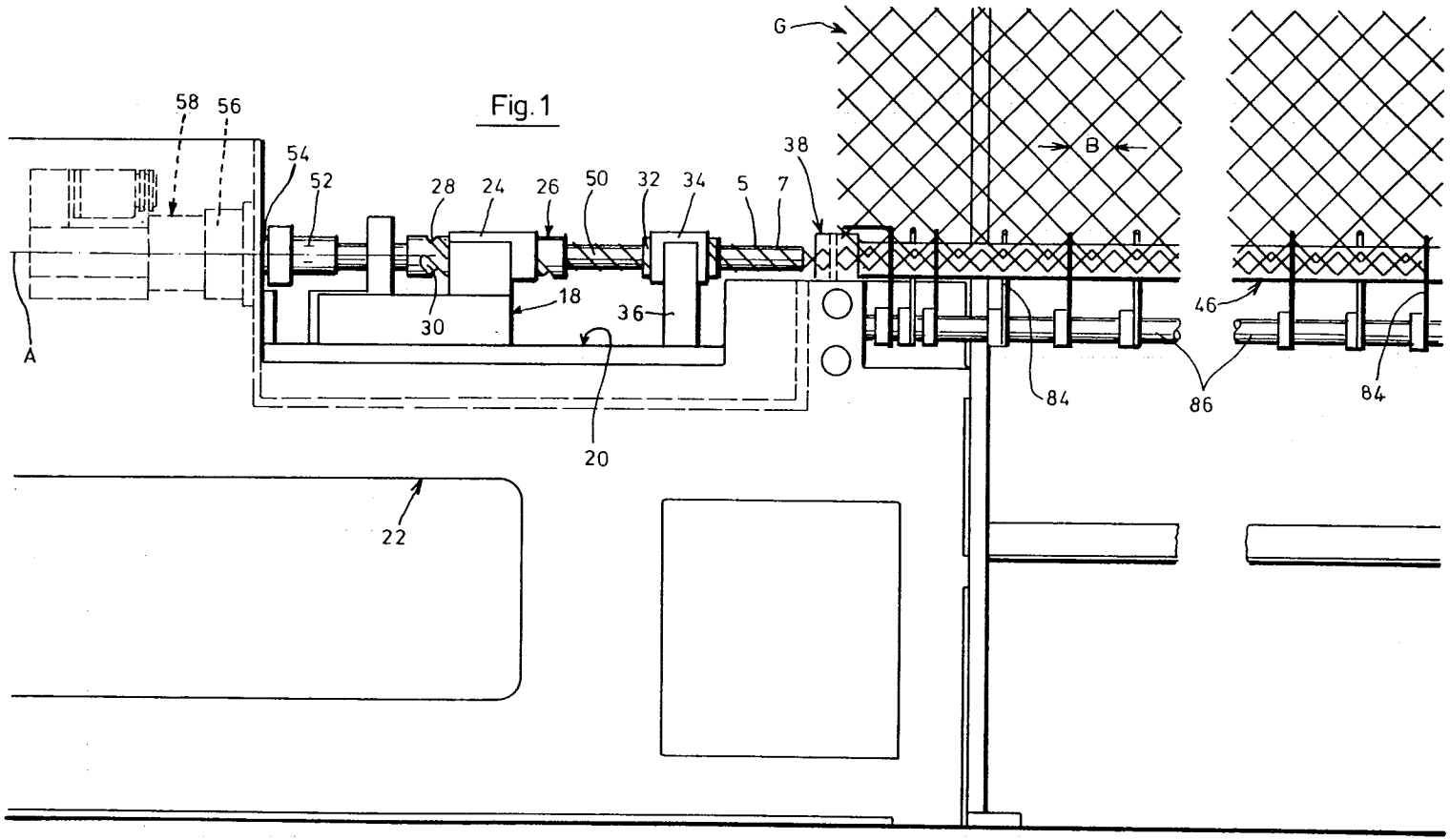
FIG. 1 is a break-away and partially schematically illustrated front view of the exemplary embodiment of the invention.
Figure 2:
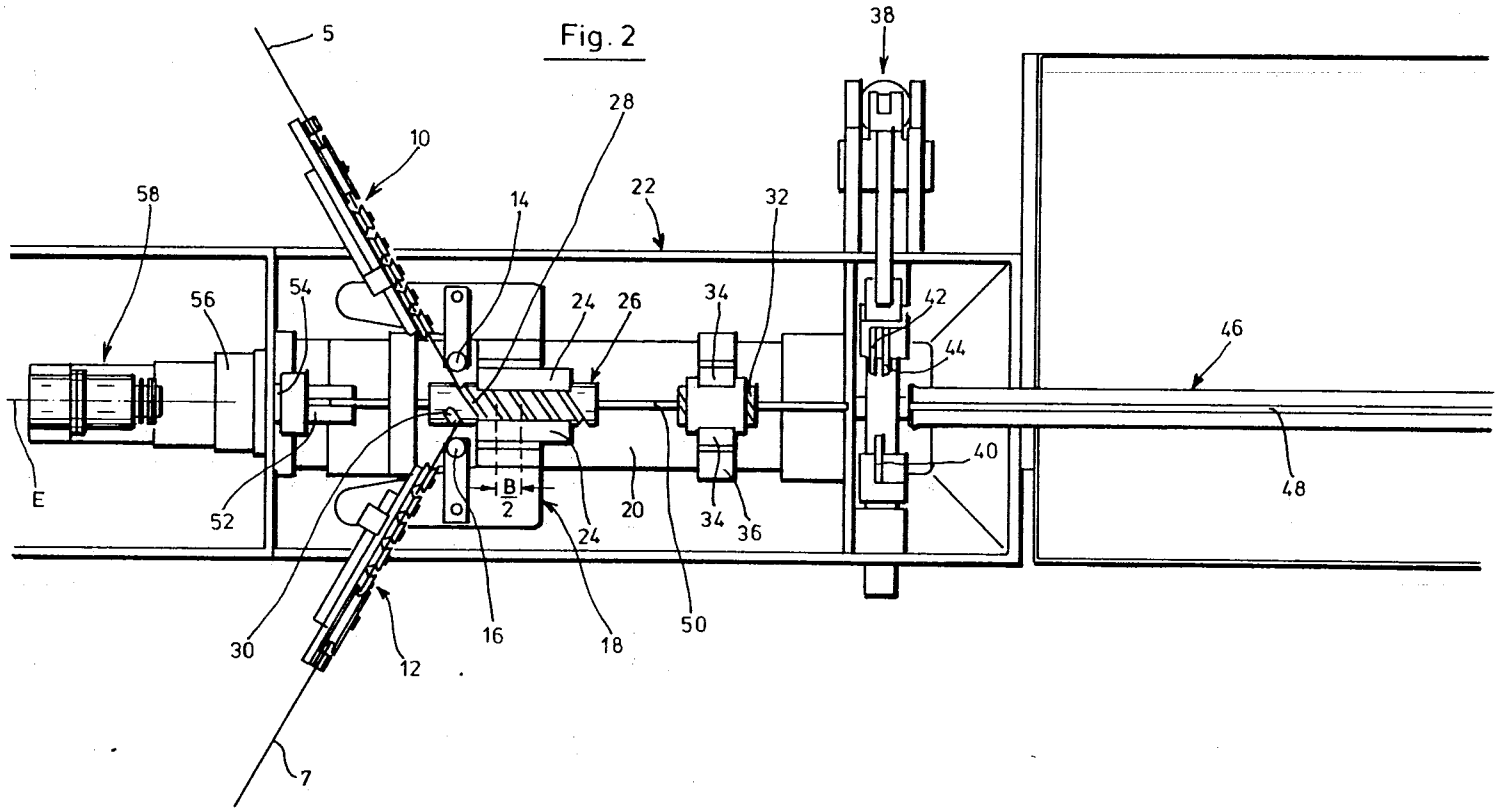
FIG. 2 is a top view of the embodiment illustrated in FIG. 1.

Referring now to the drawings wherein like parts are designated by the reference numerals throughout, there is illustrated in FIGS. 1 and 2 an exemplary embodiment of the apparatus according to the invention which is intended for and suited to the manufacture of wire net fabric made from two endless wires 5 and 7. The wires 5 and 7 are supplied horizontally to the device at the lead angle of the coils to be produced during the manufacture of fabric from the wire. The wire is supplied from two wire stores, such as wire bundles (not shown), on which, as shown in FIG. 2, two tightening devices 10 and 12 also act. Those tightening devices 10 and 12 are formed and arranged symmetrically with respect to a vertical center plane and are each adjustably mounted on a sled 18 together with respective take-up rolls 14 and 16, which sled is adjustably bedded on a horizontal guide 20 of a frame 22 parallel to an axis A lying in the center plane E.

Two identical, symmetrically arranged clamping plates 24 are rigidly arranged on the sled 18. Those clamping plates 24 hold a double-tracked weaving worm screw 26 of the type disclosed, for example, in DE-PS No. 423 709, in such a manner that the worm screw can neither rotate about the axis A nor be shifted along same, relative to the sled 18. The weaving worm screw 26 includes two helical guide grooves 28 and 30 which receive the wires 5 and 7, and which are supplied tangentially at the top and bottom, respectively.

The guide grooves are axially displaced relative to each other by one half of the opening width B of the fabric G to be manufactured. Axially aligned with the weaving worm screw 26, according to DE-PS No. 423 709 (Wafios), is a second weaving worm screw, the so-called regulating worm screw 32. That regulating worm screw is arranged on two clamping plates 34 which are attached to their own sled 36, and which can be adjusted along the guide 20. A horizontally arranged, hydraulically activatable cutting device 38, having a counter-blade 40 as well as shear blades 42 and 44 for the wires 5 and 7, is arranged asymmetrically to the center plane E on the side of the regulating worm screw 32 opposite the weaving worm screw 26. On the side of the cutting device 38 opposite the regulating worm screw 32, a circular weaving tube 46 is arranged, the longitudinal axis of which coincides with the axis A. That circular viewing tube 46 has a completely penetrating slot 48 along a line on its cover parallel to the axis, which slot is formed in the top of the weaving tube. A coiling device (not shown) is provided behind the weaving tube 46 to roll up the fabric G manufactured from the wires 5 and 7.

A flat coiling mandrel, the so-called weaving blade 50, is rotatably mounted with its edge in the circular-cylindrical hollow chambers of the two worm screws 26 and 32 and with its longitudinal axis coinciding with the axis A. The weaving blade 50 extends in the direction of movement of the wire coils from the cutting device 38 beyond the weaving worm screw 26 into an opening 52 at the end of a shaft 54 which is rotatable about the axis A and is part of a hydromotor 56 of an electro-hydraulic torque amplifier 58 to drive the weaving blade. The torque amplifier 58 includes a switch valve 60 which functions as a servovalve for the actual drive motor 56 and an electrical step motor 62, coupled with the slide of the switch valve, which functions as a set-point value indicator and is connected to an electrical or electronic control device.

Figure 3:
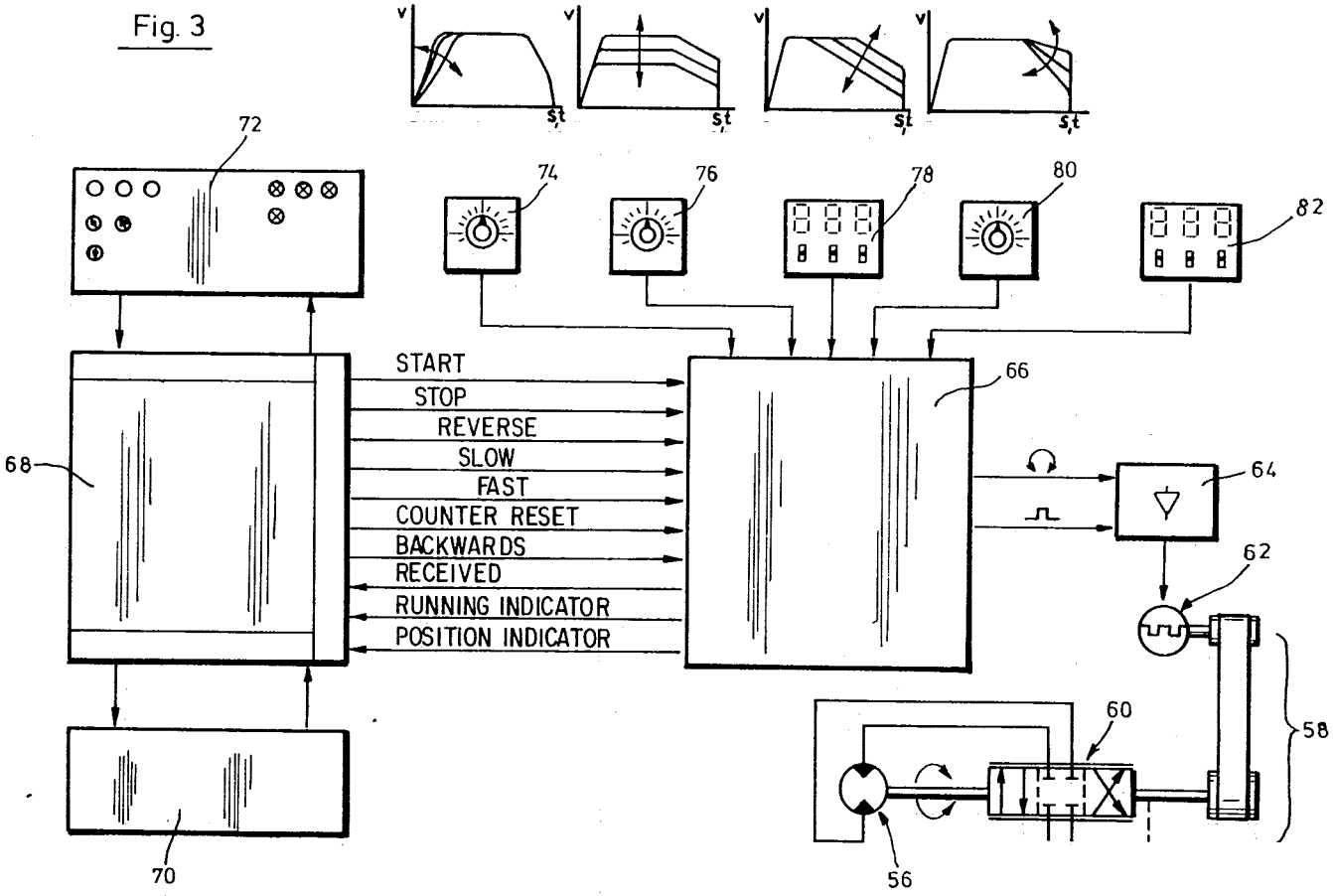
FIG. 3 is a block circuit diagram provided with symbolic pictures for several function blocks, having symbolic illustration of a rotation amplifier of the exemplary embodiment of the invention.

Referring now to FIG. 3, there is shown a constant current control 64 of the control device for the 2-phase step-motor 62 which is connected to the electro-hydraulic torque amplifier 58. The control 64 receives a rotational direction signal and a frequency signal. Those signals are transmitted by a positioning element 66 of the control device if corresponding commands of a memory-programmable function element 68 of the control device are set, which control device cooperates with the positioning element 66 in accordance with the 37 master-slave" principle. As illustrated in FIG. 3, in the information interface between the two large blocks, the positioning element 66 feeds information back to the function element 68. The indicating and adjusting members of the apparatus, which are symbolized by the block 70, and manually adjustable signal input members in an operating field 72, are connected to that function element 68.

In addition, manually adjustable data input members are connected to the positioning element 66, which is cyclically started and controlled by the function element 68. In FIG. 3, those data input members, from left to right, are a potentiometer 74 to simultaneously coordinate the rate of increase and the end of an acceleraton curve of the rotational speed v of the weaving blade 50 illustrated above the block 74 under the double arrow; a potentiometer 76 to establish a constant rotational speed of the weaving blade, illustrated above the block 76 under the double arrow; a preselection switch 78 to determine the beginning of a delay curve of the rotational speed of the weaving blade, as illustrated above the block 78 under the double arrow; a potentiometer 80 to determine the rate of decline of the delay curve illustrated above the block 80 under the double arrow and, if necessary, to simultaneously determine the end of that curve; and a preselection switch 82 to adjust the step speed of the step motor 62 necessry to produce a wire coil of the fabric G, i.e. to adjust the width of the fabric.

The method of operation of the inventive apparatus is as follows:

Beginning from a condition in which the activity of the cutting device 38 has ended, the finished section of the fabric G to be manufactured is pulled away from the weaving tube 46 in a transport step for a period of time until the most-recently threaded wire coil lies outside the weaving tube 46 with its suspended lower bent loops lying inside the weaving tube. In so doing, prior to transport, two rows of fabric hooks 84 (FIG. 1), are pivoted in the same direction by means of a common shaft 86, so that the engaged hook points are released by the engaging fabric hooks and the ready hooks engage in a row of openings. Those two rows of fabric hooks are arranged on different sides of the fabric G and engage by rows on the hook points of the first row of hook points of the two wire coils lying outside of the weaving tube 46, or at least stand ready adjacent a row of openings. That operation serves to tighten the fabric, and after the transport, both rows of hooks are pivoted back in the opposite direction, whereby the two rows of hooks exchange their functions.

In the condition after activity of the cutting device, two flattened wire coils, which have been axially displaced relative to each other by half the opening width B of the fabric G, sit on the weaving blade 50. The lead ends of those wire coils lie in front of the weaving blade on the cutting device 38 and the tail ends thereof lie on two locations at which the endless wires 5 and 7 enter into the guide grooves 28 and 30, respectively. Those grooves, together with the corresponding guide grooves in the regulating worm screw 32, assure that the two wire coils receive a certain constant rate of increase.

To add the next two wire coils to the edge of the fabric projecting into the weaving tube 46, the hydromotor 56 is started, whereby the increasing oil supply flow causes an accelerated rotation of the weaving blade 50. That rotation carries the two wire coils sitting on the weaving blade along in the rotational direction and thereby pulls wire from the endless wires 5 and 7 through the tightening apparatus 10 and 12. Meanwhile, the beginning of the wire on both coils enters through the stopped cutting device 38 into the adjacent beginning of the weaving tube 46, whereby the wire coils are continuously replenished at their ends. Of the two wire coils that enter onto the weaving tube 46, the lead end of the wire of one of the two coils finds access to the wire coil which partially projects into the weaving tube 46, into which it is threaded with increasing speed, while the other of the two wire coils is only carried along, i.e. is not also threaded in, so that at the end it hangs on the threaded wire coil.

After the wire coil to be threaded is threaded through the first fabric openings, the oil supply to the hydromotor 56 is held constant, so that the threading of the wire coil to be added to the edge of the fabric then occurs equally rapidly. After a certain time, approximately after the lead end of the wire of the coil to be threaded is half-way through the full width of the fabric, the oil supply to the hydromotor 56 is throttled, so that the threading then takes place more and more slowly, until the weaving blade 50 has performed the predetermined number of rotations. Thereupon the weaving blade is stopped in a precise position, so that the cutting device 38 can then separate the two wire coils that are now completely added to the edge of the fabric from the two subsequent wire coils in such a manner that one thereof can then find access to the new fabric edge without disruption.

As shown at the information interface between the two large blocks in FIG. 3, the function element 68 of the control device may selectively influence its positioning element 66 in such a manner that in adjusting operation the positioning of the weaving blade 50 can selectively occur at a very slow or a very rapid pace for adjustment or testing purposes.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. Apparatus for the manufacture of a wire net fabric made from at least one straight supplied endless wire, said apparatus comprising:

a stationary twisting worm screw having a helical guide groove for holding said at least one supplied wire;

a flat coiling mandrel which cooperates with said twisting worm screw and which receives a flat-drawn coil formed from said at least one wire;

a circular twisting tube having an entrance which receives the coil from the mandrel;

drive means for rotating said mandrel about its longitudinal axis;

said drive means comprising hydro-motor means operatively connected for driving said coiling mandrel;

said drive means further comprising electro-hydraulic torque amplifier means, operatively connected to said hydro-motor means, for accelerating the rotational speed of said hydro-motor and thus of said coiling mandrel;

a source of hydro-oil;

a servovalve operatively connected to control the flow of oil to said hydro-motor;

step motor means, coupled to said servovalve, for adjusting the set point of said servovalve;

positioning means for producing signals determinative of desired operating conditions including rotational speed and acceleration of the mandrel of said coiling mandrel for predetermined points in time; and a programmable function element connected to said positioning means for receiving signals from and cooperating with said positioning means in accordance with the master/slave principle for controlling said step motor means to operate said switch means such that said coiling mandrel is operated in accordance with said desired operating conditions over different points in time predetermined by said positioning means.

2. Apparatus according to claim 1, wherein the programmable function element cyclically starts and controls the positioning means according to the "master-slave" principle.

3. Apparatus according to claim 2, further including indicating and adjusting members connected to the function element.

4. Apparatus according to claim 3, wherein the function element includes manually adjustable signal input members.

5. Apparatus according to claim 3, wherein the function element includes a programmed memory device.

6. Apparatus according to claim 5, wherein the function element includes manually adjustable signal input members.

7. Apparatus according to claim 1, wherein said positioning means is provided with a manually adjustable data inputting member comprising a potentiometer to simultaneously coordinate the rate of climb and the end of an acceleration curve of the rotational speed of said coiling mandrel.

8. Apparatus according to claim 7, wherein the positioning means is provided with a preselection switch to adjust the step speed of the step motor necessary to produce a wire coil.

9. Apparatus according to claim 1, wherein said positioning means is provided with a manually adjustable data inputting member comprising a potentiometer to establish a constant rotational speed of said coiling mandrel.

10. Apparatus according to claim 1, wherein the positioning means is provided with a pre-selection switch to adjust the number of steps of the step motor necessary to produce one wire coil.

11. Apparatus according to claim 1, wherein said positioning means is provided with a manually adjustable data inputting member comprising a preselection switch which determines the begining of a delay curve of the rotational speed of said coiling mandrel.

12. Apparatus according to claim 11, wherein the positioning means is provided with a pre-selection switch to adjust the speed of the step motor necessary to produce a wire coil.

13. Apparatus according to claim 1, wherein said positioning means is provided with a manually adjustable data inputting member comprising a potentiometer which determines the rate of decline of a delay curve of the rotational speed of said mandrel and simultaneously determines the end of such curve, if necessary.

14. Apparatus according to claim 13, wherein the positioning means is provided with a pre-selection switch to adjust the speed of the step motor necessary to produce a wire coil.

* * * * *